US006767256B1

(12) United States Patent
Faerber et al.

(10) Patent No.: US 6,767,256 B1
(45) Date of Patent: Jul. 27, 2004

(54) CIGARETTE LIGHTED ADAPTOR WITH MECHANICAL STEPPER JOINT

(75) Inventors: Paul J. Faerber, Lawrenceville, GA (US); William C. Phelps, III, Lawrenceville, GA (US); Sean N. Davie, Lawrenceville, GA (US); Douglas A. Vine, Suwanee, GA (US)

(73) Assignee: Motorola, Inc., Schaumburg, IL (US)

( * ) Notice: Subject to any disclaimer, the term of this patent is extended or adjusted under 35 U.S.C. 154(b) by 161 days.

(21) Appl. No.: 10/387,309

(22) Filed: Mar. 12, 2003

(51) Int. Cl.[7] ..... H01R 24/04
(52) U.S. Cl. ..... 439/668; D13/144
(58) Field of Search ..... 439/668; 379/446; 455/90; D13/144

(56) References Cited

U.S. PATENT DOCUMENTS 5,086,958 A 2/1992 Nagy
5,179,590 A 1/1993 Wang
5,839,919 A * 11/1998 Chen ..... 439/529
5,847,545 A 12/1998 Chen et al.
5,967,807 A 10/1999 Wu
D463,369 S * 9/2002 Eisenbraun ..... D13/144
6,478,628 B1 11/2002 Ming
6,551,142 B2 * 4/2003 Eisenbraun ..... 439/668

* cited by examiner

*Primary Examiner*—Tho D. Ta
(74) *Attorney, Agent, or Firm*—Philip H. Burrus, IV

(57) ABSTRACT

A cigarette lighter adaptor for a portable electronic device is provided. The adaptor includes a handle and dongle coupled together by way of a mechanical stepper joint. The stepper joint includes a hinge that engages to resist angular forces applied to the handle relative to the dongle. In one preferred embodiment, the stepper joint includes a convex member with protruding members that act as gear teeth. The stepper joint has a corresponding concave member with détentes. When assembled, these features create the détente positions for the stepper joint. The détente positions are accomplished by allowing the dongle to translate along the axis of the adaptor away from the handle. The stepper joint is preferably held together with an elastic member wrapped about a pin within the stepper joint.

9 Claims, 12 Drawing Sheets

CIGARETTE LIGHTED ADAPTOR WITH MECHANICAL STEPPER JOINT

BACKGROUND

1. Technical Field

This invention relates generally to power adaptor for a portable electronic device that is mechanically structured so as to fit in the cigarette lighter of a vehicle, and more specifically to a cigarette lighter adaptor having a moveable, mechanical stepper joint to allow movement between the dongle and handle of the cigarette lighter adaptor.

2. Background Art

Many modern vehicles are provided with cigarette/cigar lighters. The lighter usually comprises a circular, socket aperture with a removable lighter cap. When actuated, electrical current flows through a high resistance element in the lighter cap, thereby causing the element to glow red-hot. A cigarette or cigar can then be ignited from the glowing metal.

The lighter socket can also be used to power a large range of portable appliances, for example, mobile phones, car vacuum cleaners, lap-top computers, televisions, chiller cabinets, etc. Recently, the sockets on their own (without the cigarette lighter cap) have been provided in cars, off road and other vehicles. Sockets without cigarette lighter caps are often labeled simply as "power" sockets. While some appliances are powered directly from the socket itself, others may require an adaptor.

The typical cigarette lighter adaptor has a dongle and a handle. The dongle is a plug member that is inserted into the vehicle lighter socket. The dongle is elongate with a first electrical contact at one end. The first electrical contact connects to a co-operating electrical contact at the base of the lighter socket. To ensure a good and reliable connection, it is preferable if the first electrical contact is mounted on the dongle such that the contact is resiliently biased towards the end of the dongle. In prior art adaptors, the first contact is electrically and mechanically connected to the remainder of the adapter via a spring. The dongle also includes a second electrical contact that is generally a pair of curved leaf springs that provide both an electrical connection and a mechanical friction force with/against the lighter socket.

Most prior art adaptors are manufactured in a single, rigid piece. Thus, the angle of the handle—the portion of the adaptor that couples to the portable electronic device—is dependent upon the geometric orientation of the lighter socket. Some designers have attempted to add moveability to the handle (relative to the socket) by adding hinged members. For example, U.S. Pat. No. 6,478,628, issued to Ming, teaches an adaptor with a hinged dongle. The problem with adaptors like than in the '628 patent is that their dongle-handle interface comprises a friction-based mechanical connection. In other words, the only thing that keeps the dongle at the proper angle relative to the handle is the friction applied by the handle material (usually plastic) against the dongle material (also usually plastic). After only a few dongle-handle angle adjustments, this joint can wear, thereby causing the handle to sag.

There is thus a need for an improved adaptor with a more robust handle-dongle interface.

DETAILED DESCRIPTION OF THE INVENTION

Figure 1:
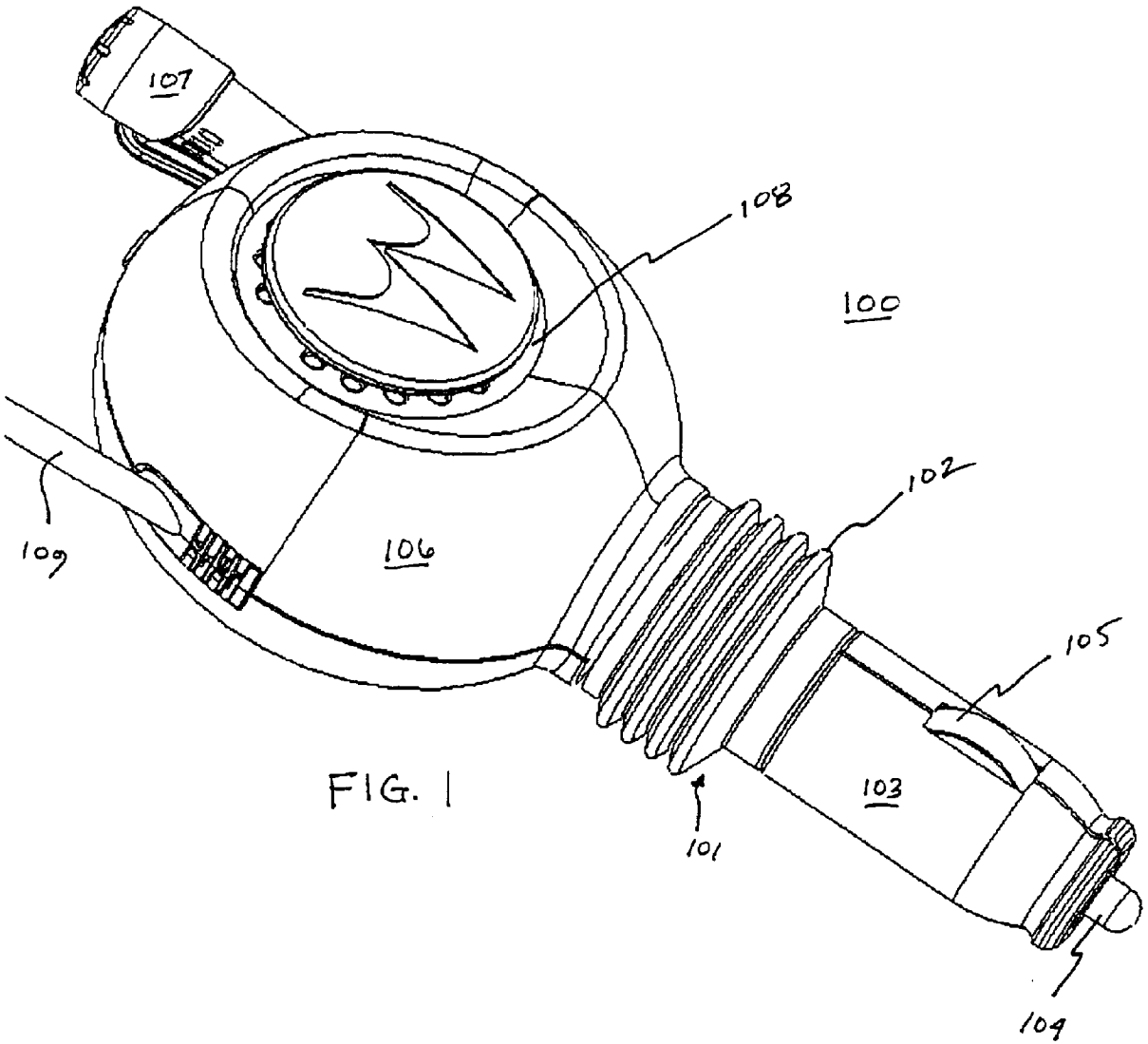
FIG. 1 illustrates one preferred embodiment of a cigarette lighter adaptor with a mechanical stepper joint in accordance with the invention.

A preferred embodiment of the invention is now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on."

Referring now to FIG. 1, illustrated therein is one preferred embodiment of a cigarette lighter adaptor 100 with a mechanical stepper joint 101 in accordance with the invention. The adaptor 100 comprises a handle 106 and a dongle 103. The handle 106 and dongle 103 are preferably constructed from a rigid plastic material, like ABS, polycarbonate, or equivalent, and are preferably manufactured by way of an injection molding process. The dongle 103 preferably comprises at least a first 104 and second 105 electrical contacts for coupling to corresponding electrical contacts in an automotive lighter socket.

The stepper joint 101 (recited in detail below) is optionally covered by a rubber casing 102 in FIG. 1. The rubber casing 102 serves to protect any openings in the stepper joint 101 from debris, as well as providing an aesthetically pleasing appearance.

For exemplary purposes, the adaptor 100 of FIG. 1 is shown as a hands-free, speaker phone adaptor comprising a microphone 107 and speaker 108, although the invention is not so limited. The adaptor 100 could equally comprise a power supply, a charger with charging circuitry, a mechanical holder for the electronic device or any combination or equivalent thereof. The adaptor 100 includes an interface 109 for coupling to a portable electronic device (not shown) like a cellular telephone, radio, pager, laptop computer or television. The interface 109 is preferably a cable with a device specific connector mounted thereto, but may equally be a fixed connecter mounted to the handle 106.

Figure 2:
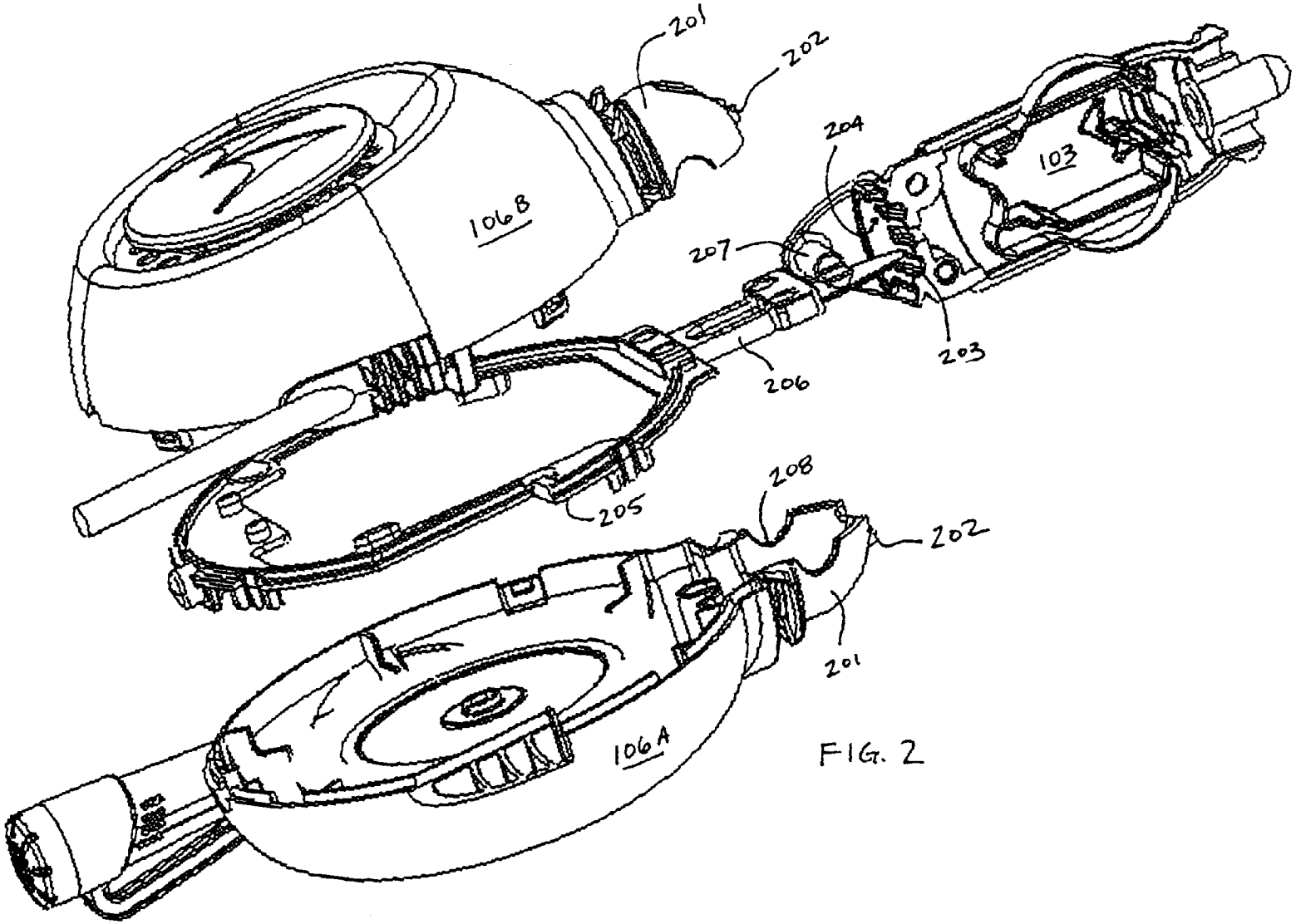
FIG. 2 illustrates an exploded view of an adaptor in accordance with the invention.

Referring now to FIG. 2, illustrated therein is an exploded view of an adaptor in accordance with the invention. In FIG. 2, the details of the stepperjoint are more clearly illustrated. The stepper joint preferably comprises a convex member 201 mounted to the handle 106 having at least one protruding member 202. The protruding members 202 look like "teeth" about the convex member. Note that the handle 106 is preferably comprised of two halves 106A, 106B, thereby allowing circuitry, speakers and the like to be easily disposed within the two halves 106A, 106B.

The convex member 202 mates with a corresponding concave member 204 mounted on the dongle 103. The dongle 103 of FIG. 2 is illustrated in a sectional view so as to better illustrate the interior components. The concave member 204 has at least one détente 203 that corresponds to at least one protruding member 204.

The convex member 201 and concave member 204 are preferably coupled together by way of an elastic member 205 that includes an elongated portion 206. The elastic member is preferably made of a stretchy, rubber material, and is similar in many respects to a robust rubber band or belt. The elongated portion 206 wraps about a pin 207 disposed within the dongle 103, thereby exerting a force against the pin 207 in the direction of the handle 106. In the hands-free speaker phone application, the elastic member 205 may be tailored to match the edges of the upper and lower housings 106A, 106B, so as to serve the dual function of a gasket.

Figure 3:
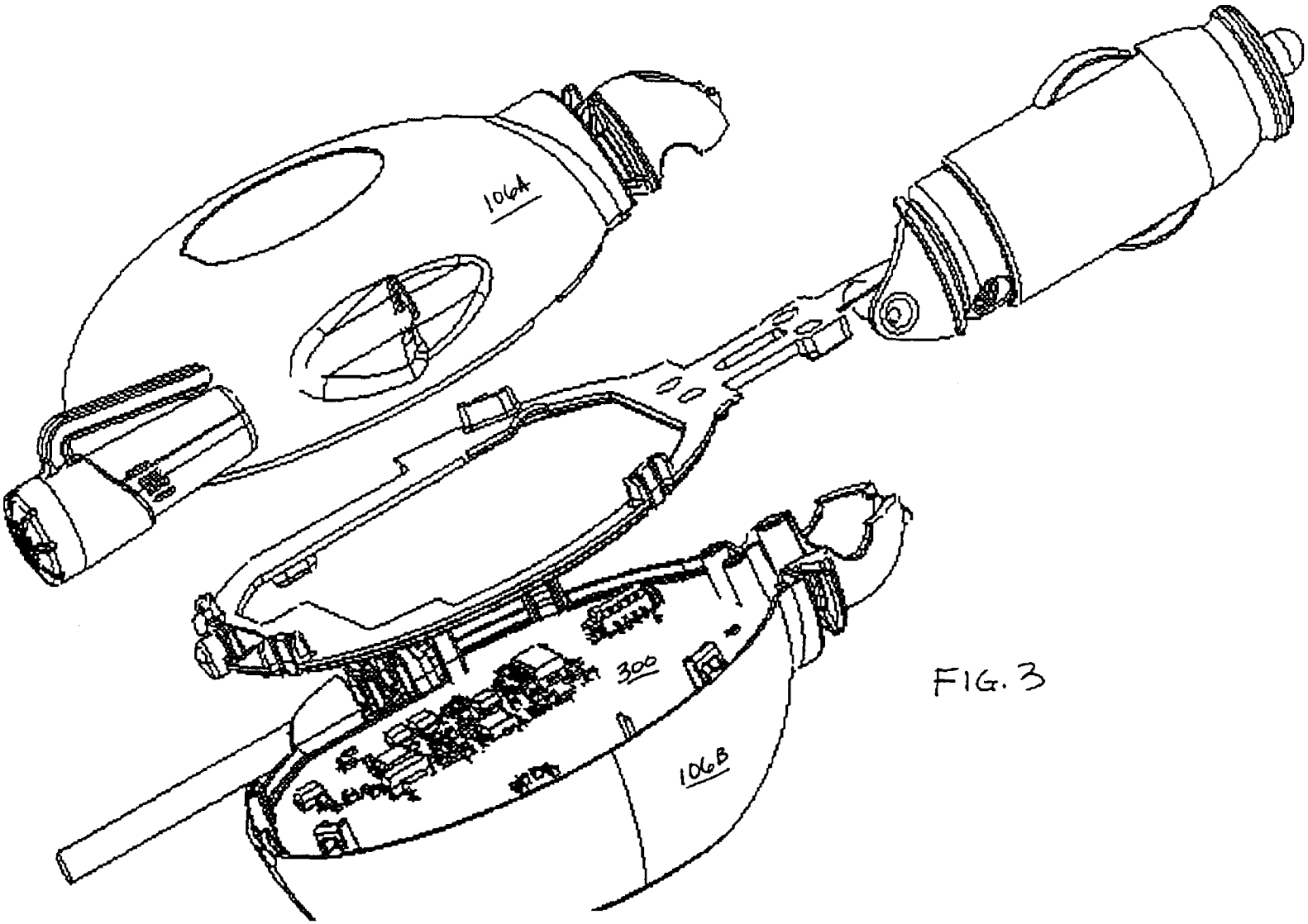
FIG. 3 illustrates a bottom, left, isometric, exploded view of the adaptor.

While FIG. 2 is a top, right, back, isometric, exploded view of an adaptor in accordance with the invention, FIG. 3 illustrates a bottom, left, isometric, exploded view of the adaptor. The perspective of FIG. 3 illustrates an optional circuit board 300 having electronic components disposed thereon to be seen. The circuit board 300 may be disposed in either the top 106B or bottom 106A housing. The circuit board 300 is electrically coupled to the first and second electrical contacts (elements 104, 105 of FIG. 1) by current conducting materials.

Figure 4:
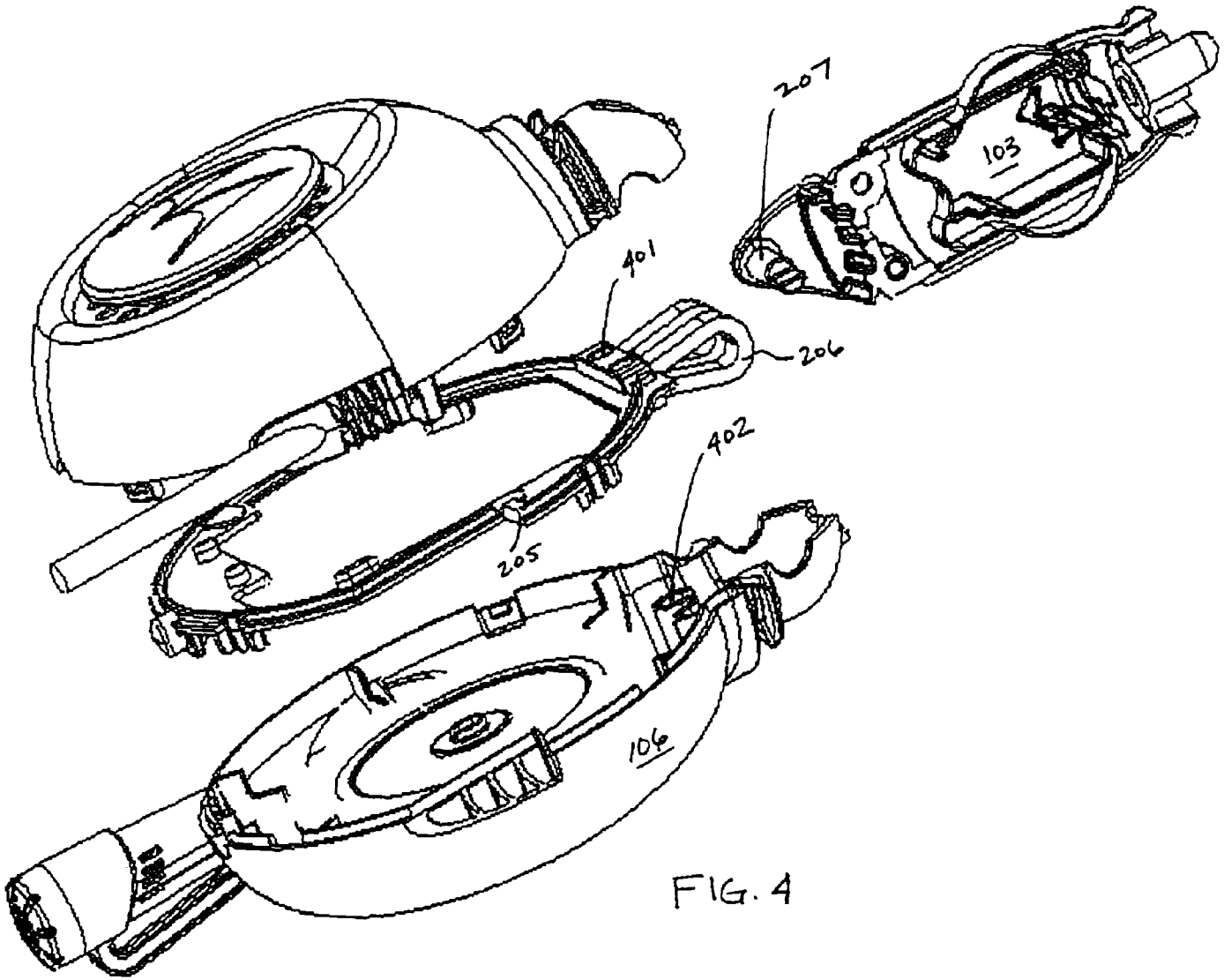
FIG. 4 illustrates a top, right, back, isometric, exploded view of an adaptor in accordance with the invention.

Referring now to FIG. 4, illustrated therein is a top, right, back, isometric, exploded view of an adaptor in accordance with the invention, similar to the view of FIG. 2. The difference between FIG. 2 and FIG. 4 lies with the elastic member 205. In FIG. 4, the elongated portion 206 of the elastic member 205 has been folded back upon itself. Both the elastic member 205 and the elongated portion 206 include apertures 401 that mechanically couple about a corresponding number of bosses 402 disposed within the handle 106.

The folding of FIG. 4 is shown without the elongated member 206 wrapping around the pin 207 of the dongle 103 for illustrative purposes. The elongated member 206 in practice wraps about the pin 207, although the pin may be inserted into the loop formed by the elongated member 206 after folding as manufacturing procedures require.

Figure 5:
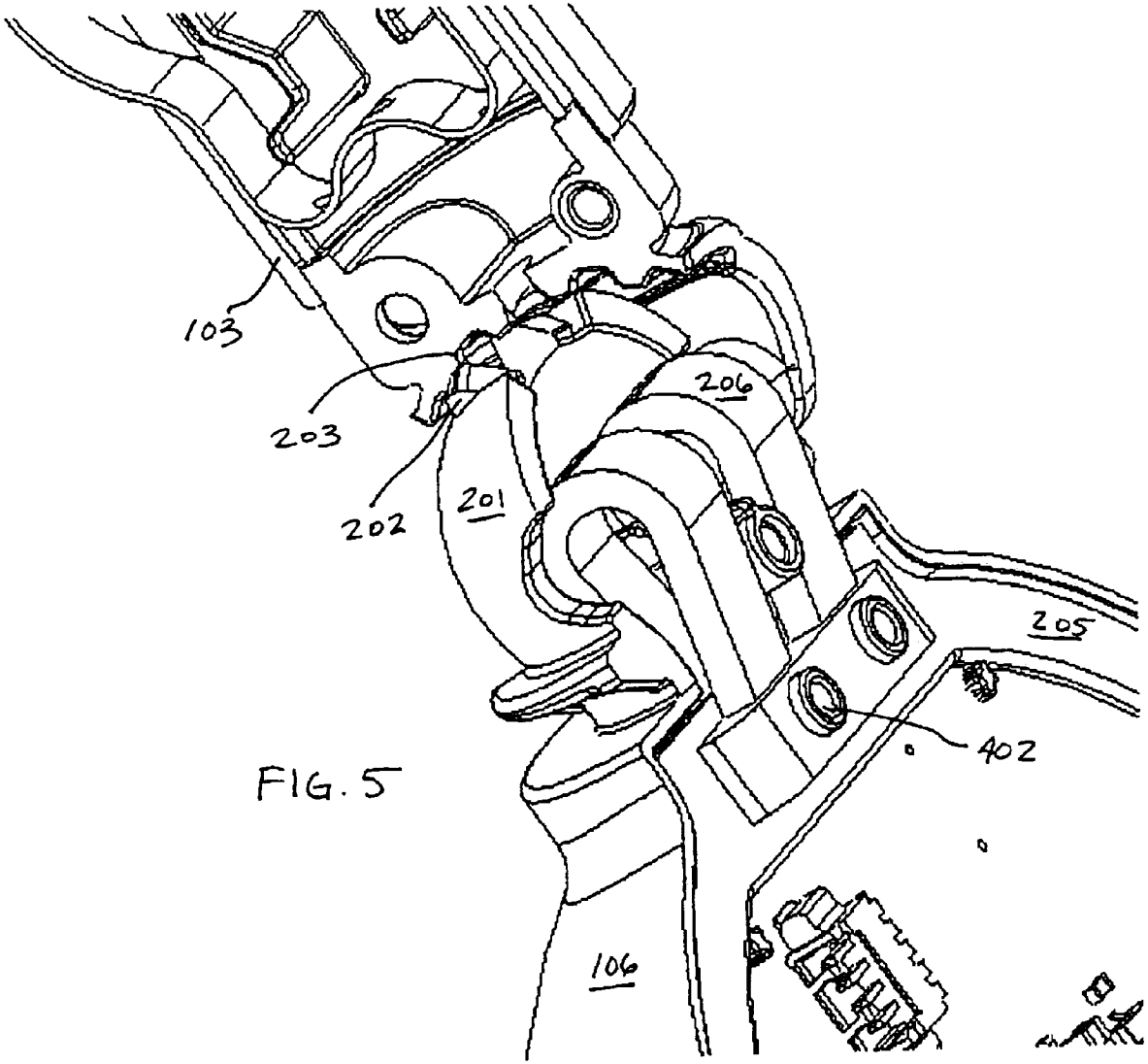
FIG. 5 illustrates a close-up, cut away view of a stepper joint in accordance with the invention.

Referring now to FIG. 5, illustrated therein is a close-up, cut away view of a stepper joint in accordance with the invention. The elongated member 206 has been folded about the pin of the dongle 103. (Note that the pin is not clearly visible in FIG. 5 due to the fact that the elongated member 206 is wrapped about it. Also note that only half of the pin is shown due to the fact that the dongle 103 has been cut away to expose the interior components.) The elongated member attaches to the bosses 402 disposed within the handle 106. In this preferred embodiment, the elongated member 206 also serves as the gasket 205.

Figure 6:
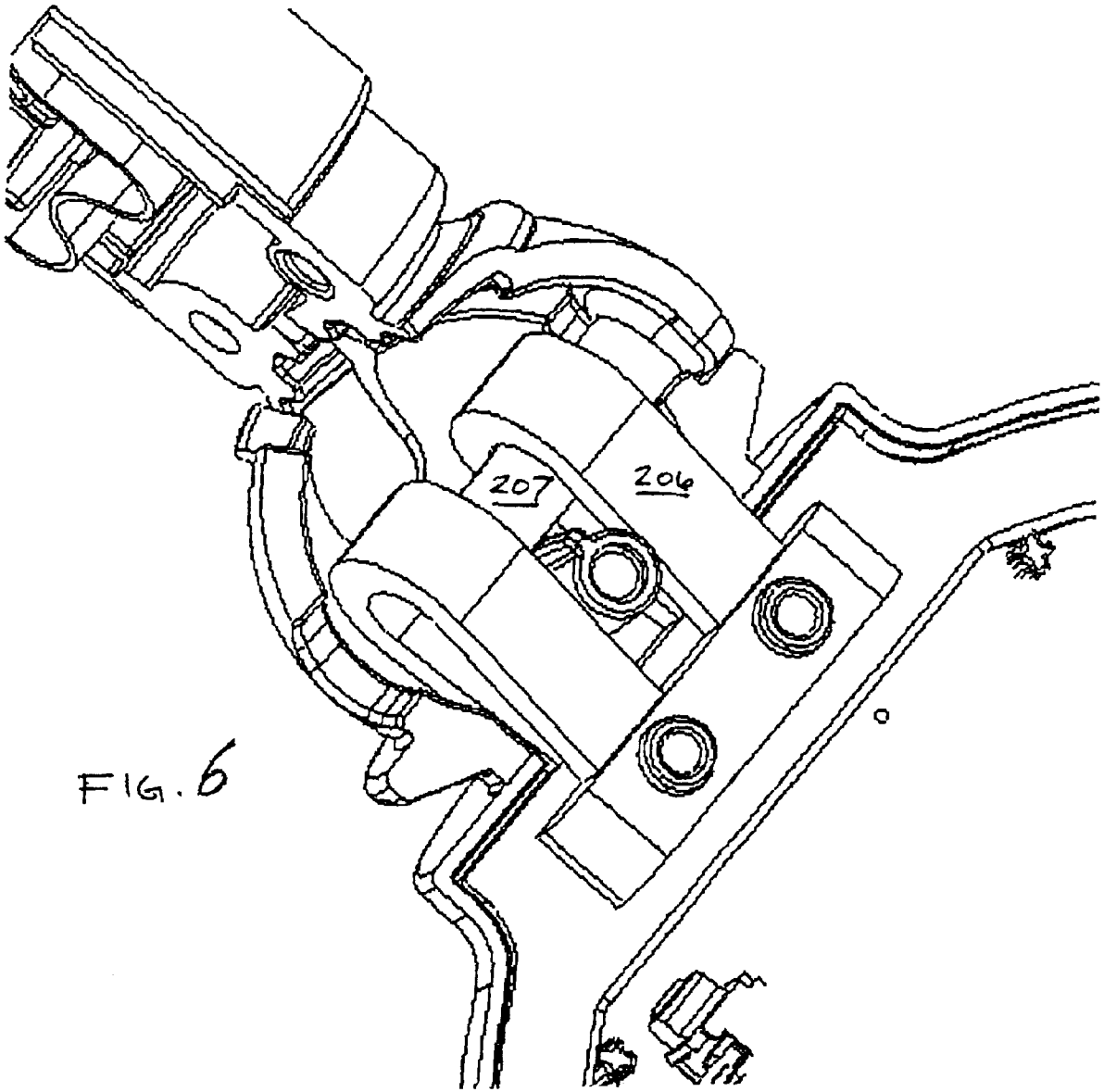
FIG. 6 is FIG. 5, with perspective rotated approximately 30 degrees.

FIG. 5 offers an illustration of the protruding members 202 disposed on the convex member 201 mating with the détentes 203 in the dongle 103. FIG. 6 is the same view as shown in FIG. 5, although the perspective has been rotated by approximately 30 degrees. The rotation allows visibility of the pin 207 seated within the elongated member 206.

Figure 7:
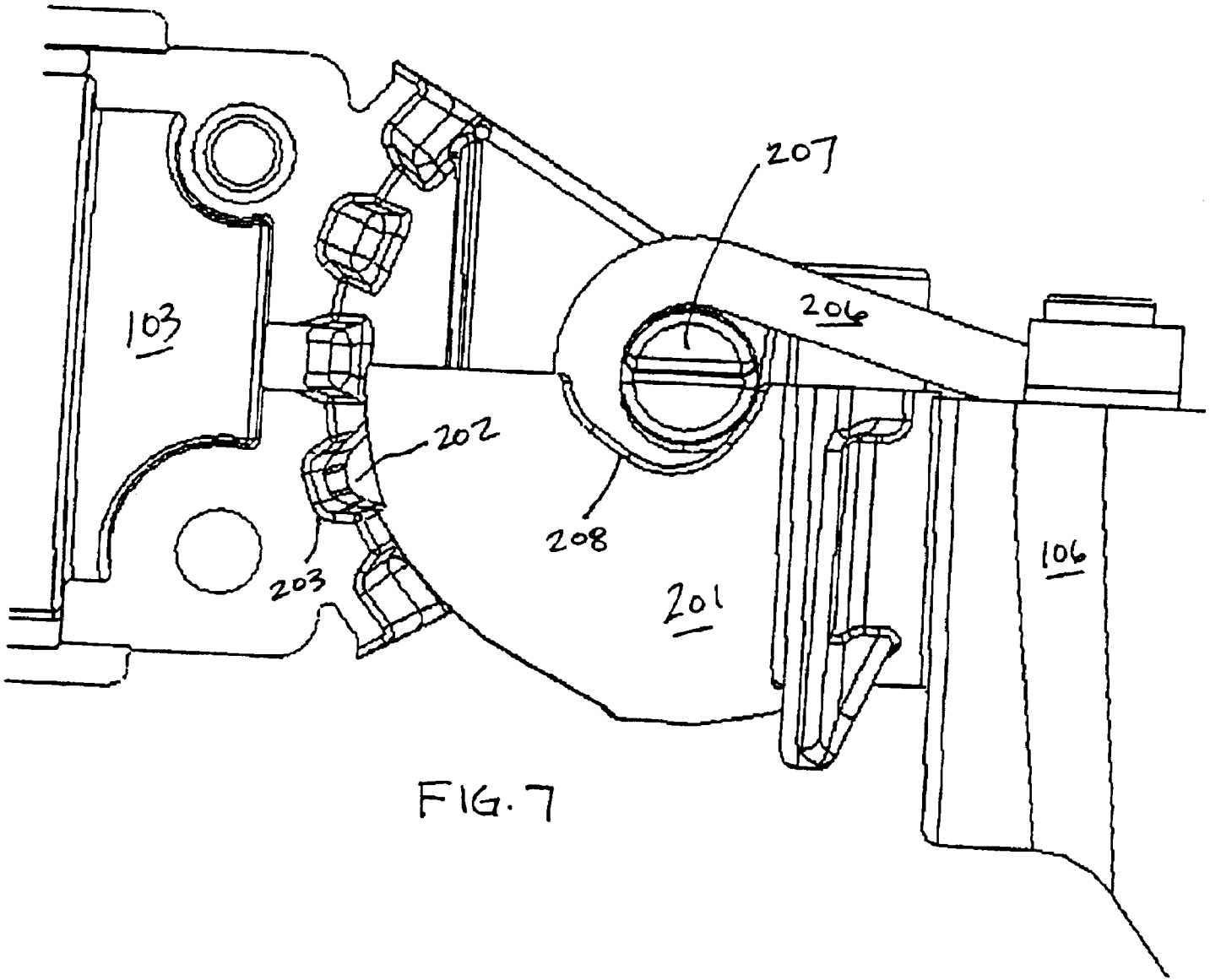
FIG. 7 illustrates a left, elevational view of a preferred embodiment of the stepper joint.

Referring now to FIG. 7, illustrated therein is a left, elevational view of a preferred embodiment of the stepper joint. As previously shown, the elongated member wraps 206 about the pin 207. (Note that both the handle 106 and the dongle 103 have been cut away for illustrative purposes.) The pin 207 is inserted into the convex member 201 through a non-circular aperture 208. The non-circular aperture 208 has a diameter that is longer running along a line from handle 106 to dongle 103 than the diameter that is normal to this line. This non-circular shape facilitates engagement of the protruding members 202 and the détentes 203. To disengage the stepper joint, one pulls the handle 106 away from the dongle 103, thereby disengaging the protruding members 202 from the détentes 203. This "pulling" causes the elongated member 206 to stretch, thereby exerting a force that tries to pull the handle 106 and dongle 103 together.

Figure 8:
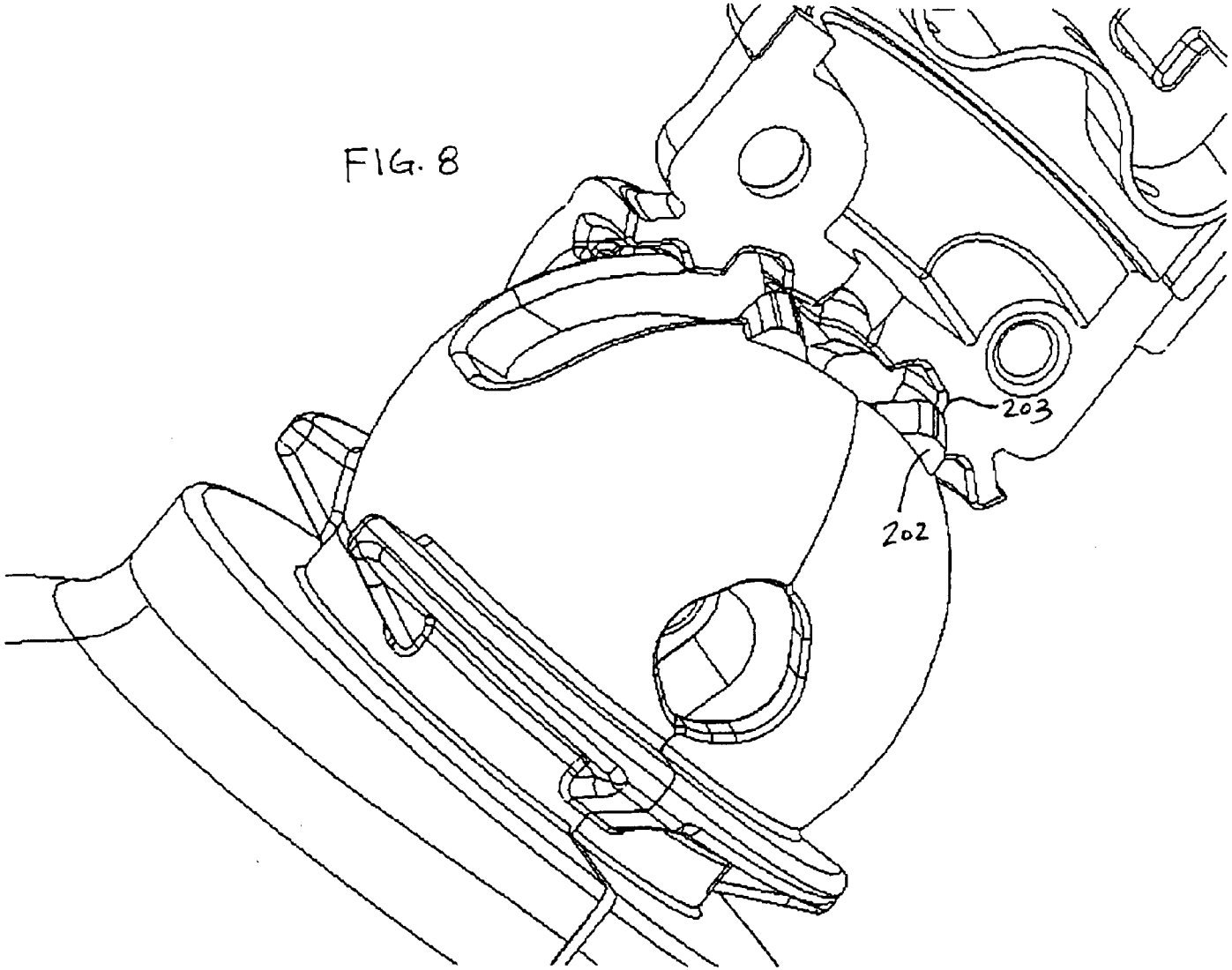
FIG. 8 illustrates a view of the protruding members disengaged from the détentes.

With the protruding members 202 and détentes 203 disengaged, one may rotate the handle 106 relative to the dongle 103 the desired amount. When the appropriate handle-dongle geometric relationship has been established, one releases the handle, thereby allowing the elongated member 206 to relax, causing the protruding members 202 to again engage the détentes 203. The engagement resists angular forces placed upon the stepper joint by way of heavy portable electronic devices being coupled to the handle 106. Note that for exemplary purposes here, the adjustment is recited as occurring when the handle 106 is pulled from the dongle 103. In practice, the adaptor would normally be coupled to a socket, and the second electrical contact (105 of FIG. 1) exerts force against the walls of the socket. This allows one to disengage the protruding members 202 from the détentes 203 simply by pulling the handle 106 away from the socket. FIG. 8 illustrates a view of the protruding members 202 disengaged from the détentes 203.

As stated in the previous paragraph, the stepper joint may be actuated by pulling the handle 106 and dongle 103 away from each other, thereby disengaging the protruding members 202 from the détentes 203. The adaptor may also be adjusted by application of sufficient angular force to the handle 106 relative to the dongle 103. The application of this force causes the protruding members 202 to act as cam members that facilitate stretching of the elongated member 206. When the angular force is removed, the elongated member 206 relaxes, thereby causing the protruding members 202 to seat in their corresponding détentes 203.

While the preferred embodiments of the invention have been illustrated and described, it is clear that the invention is not so limited. Numerous modifications, changes, variations, substitutions, and equivalents will occur to those skilled in the art without departing from the spirit and scope of the present invention as defined by the following claims. For example, while one preferred embodiment provided an elongated member wrapped around the pin, other methods of exerting a coupling force between the handle and dongle could also be used.

Figure 9:
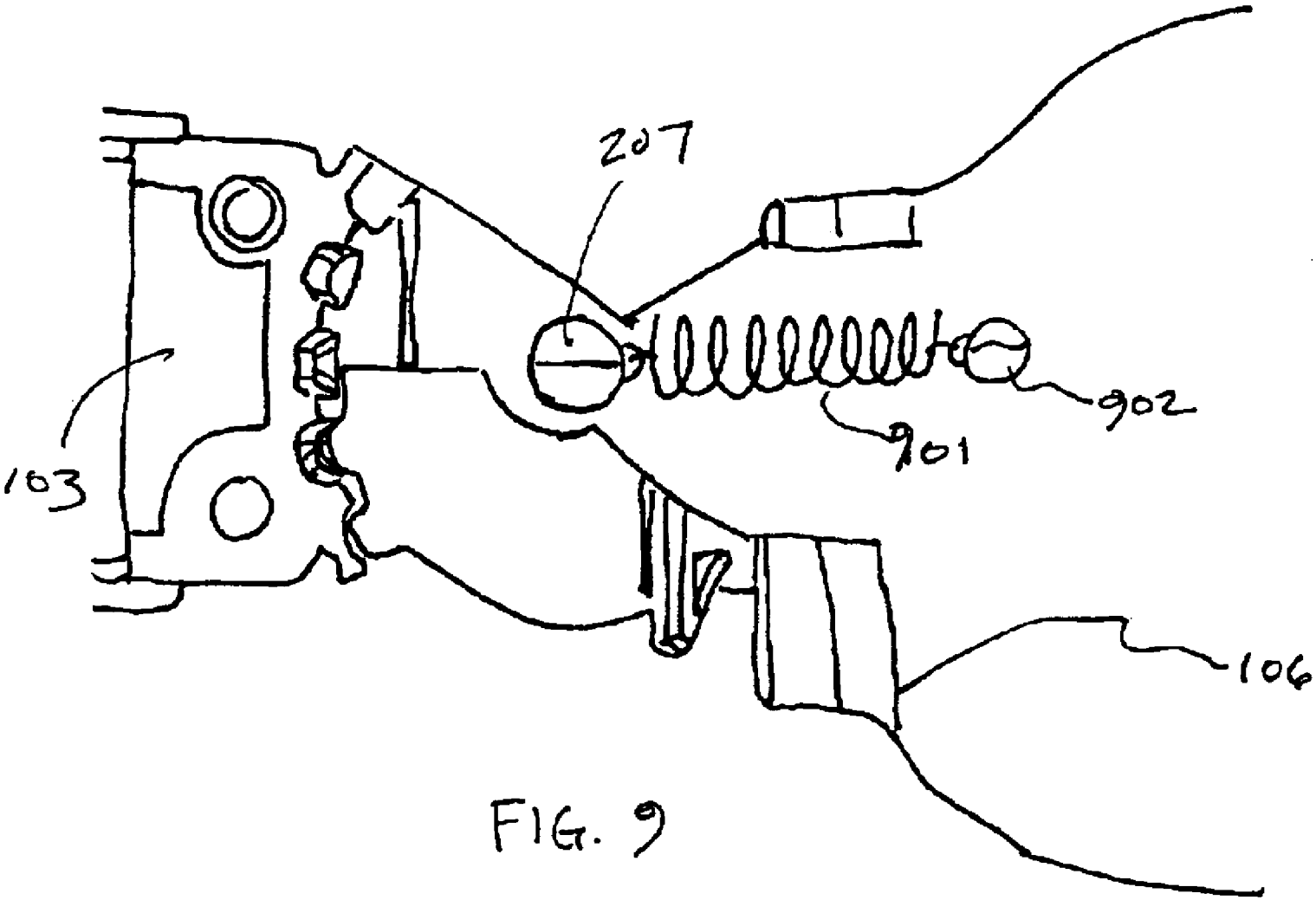
FIGS. 9–12 illustrate alternate means for coupling the handle to the dongle.

Referring now to FIG. 9, illustrated therein is an alternate means for coupling the handle 106 to the dongle 103. The method of FIG. 9 involves a coiled spring 901 coupled between the pin 207 of the dongle 103 and an anchor 902. The anchor is preferably a boss or screw disposed within the handle 106.

Figure 10:
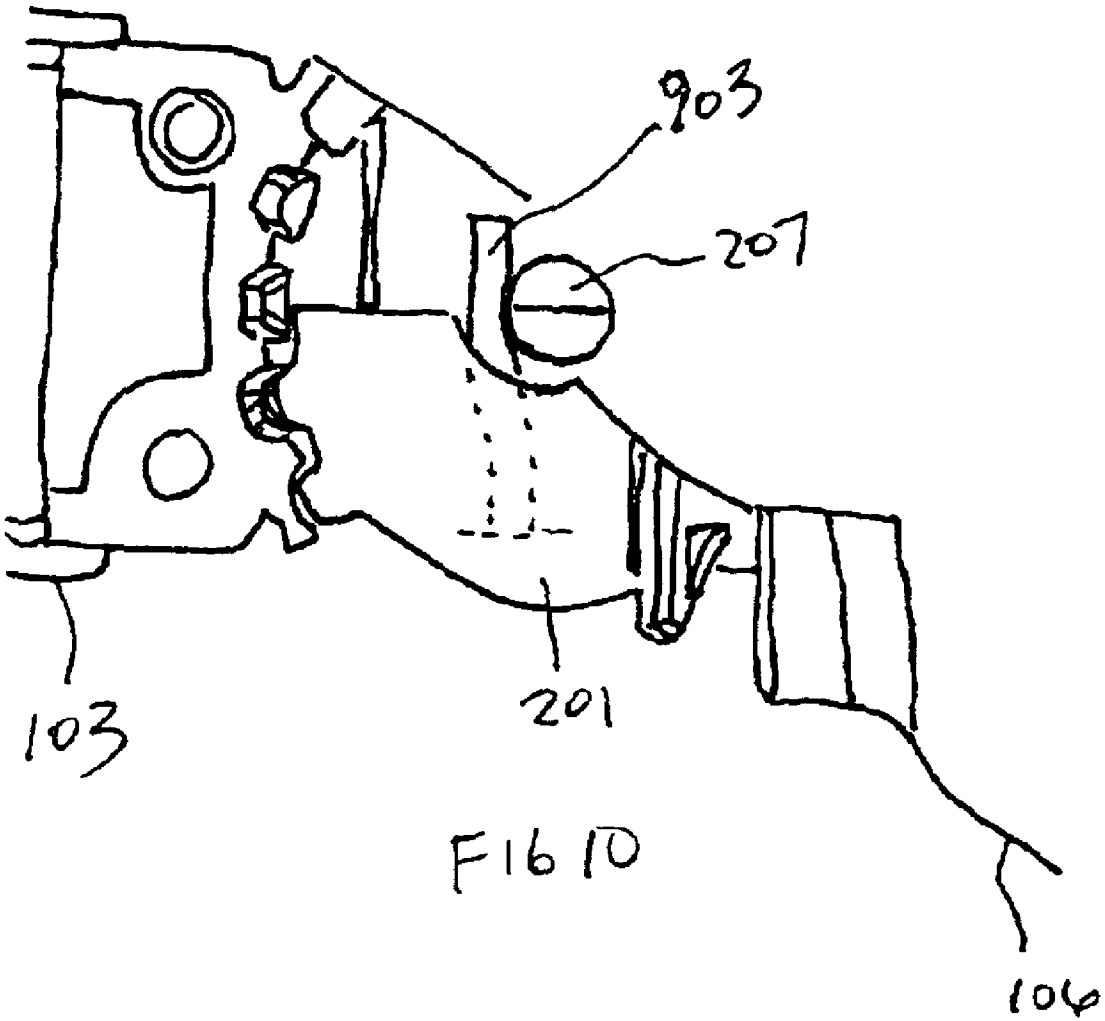
Figure 11:
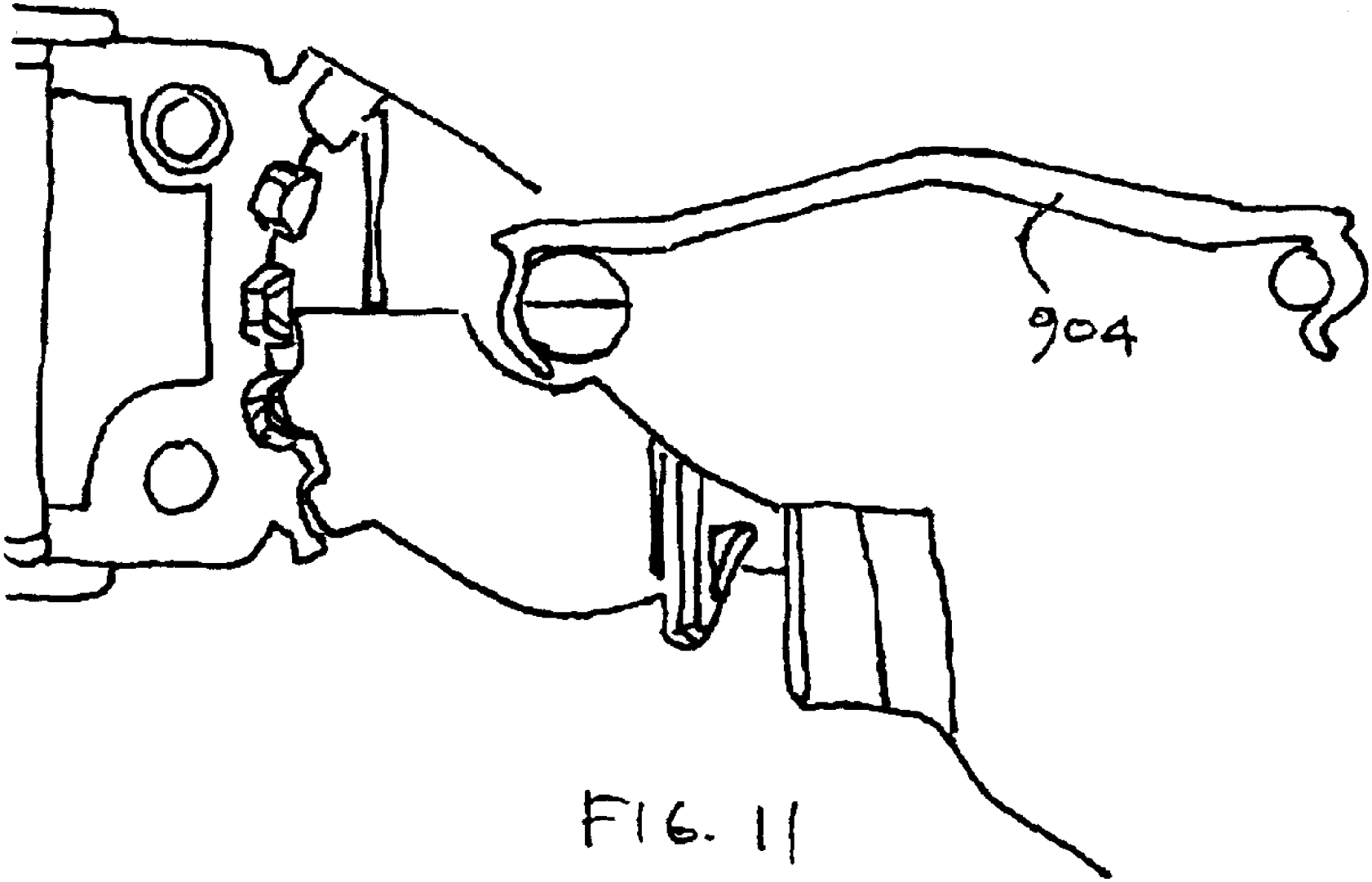
Figure 12:
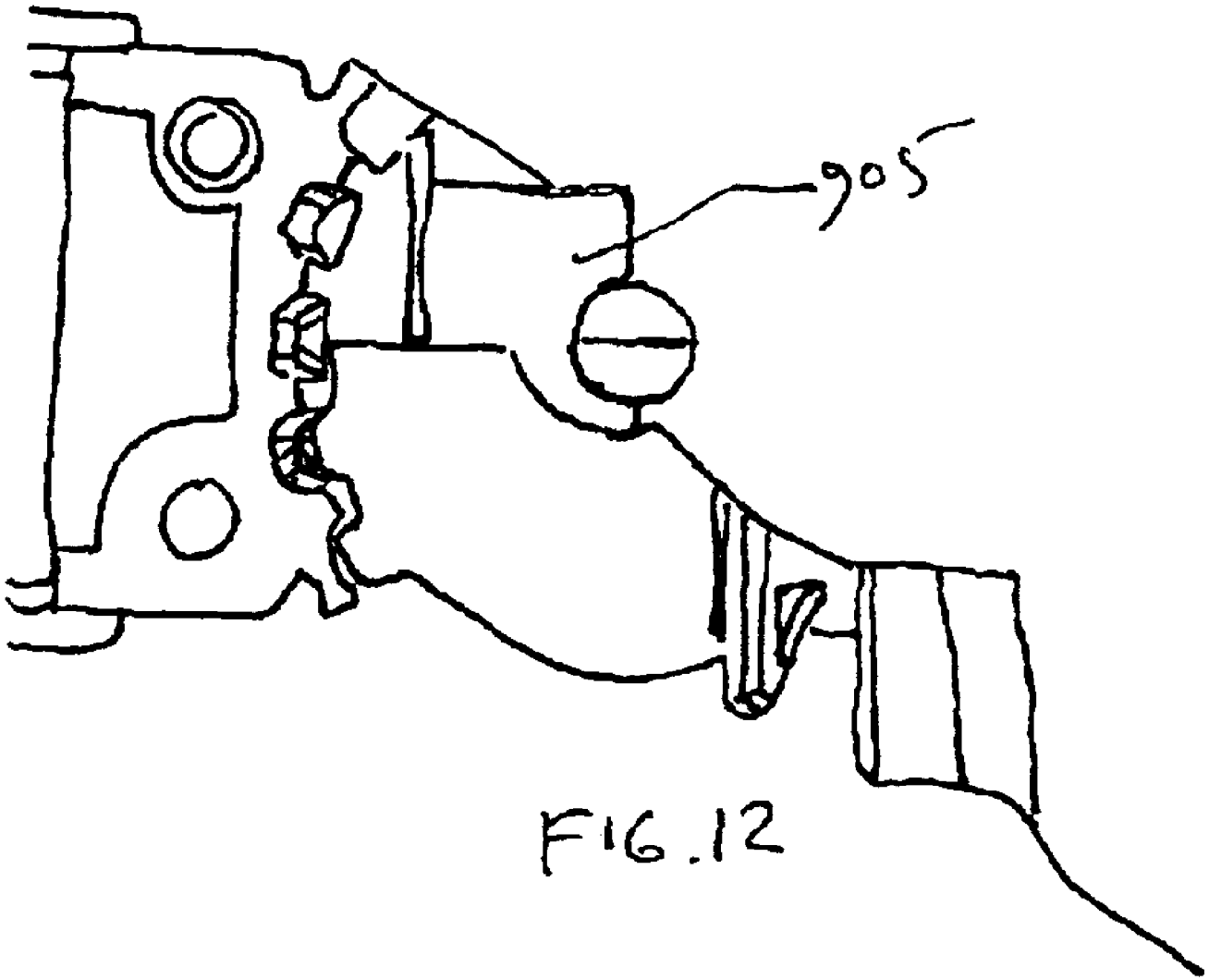

FIG. 10 illustrates another alternative coupling. In FIG. 10, a cantilever arm 903, coupled to the convex member 201 is loaded against the pin 207. When the handle 106 and dongle 103 are pulled apart, the cantilever arm 903 deflects, thereby exerting force against the pin. Other alternative coupling means include a springy metal leaf spring 904 shown in FIG. 11 and a compression rubber block 905 as shown in FIG. 12.

What is claimed is:

1. A cigarette lighter adaptor comprising a dongle and a handle, wherein the dongle and handle are coupled by way of a mechanical stepper joint; wherein the stepper joint comprises:

a. a convex member;

b. a concave member;

c. at least one protruding member; and at least one détente;

wherein the stepper joint further comprises a means of exerting force between the handle and dongle, wherein the means of exerting force is selected from the group consisting of coiled springs, compression rubber blocks, and springy metal leaf springs.

2. A cigarette lighter adaptor comprising a dongle and a handle, wherein the dongle and handle are coupled by way of a mechanical stepper joint; wherein the stepper joint comprises:

a. a convex member;

b. a concave member;

c. at least one protruding member; and at least one détente;

wherein the stepper joint further comprises a means of exerting force between the handle and dongle, wherein the means of exerting force comprises an elastic member, wherein the dongle further comprises at lease one pin, wherein the elastic member is folded about the at least one pin.

3. The adaptor of claim 2, wherein the adaptor is a device selected from the group consisting of hands-free speaker phone adaptors, chargers, and power supplies.

4. The adaptor of claim 2, wherein the at least one protruding member is disengaged from the at least one détente by pulling the handle away from the dongle.

5. The adaptor of claim 2, wherein the elastic member comprises at least one aperture, further wherein the elastic member is coupled to the handle by passing at least one boss disposed within the handle through the at least one aperture of the elastic member.

6. The adaptor of claim 5, wherein the convex member comprises at least one non-circular aperture.

7. The adaptor of claim 6, wherein the handle comprises a top and a bottom housing, further wherein the elastic member comprises a gasket seated between the top and bottom housing.

8. The adaptor of claim 2, wherein the dongle comprises at least a first and second electrical contacts for coupling to a vehicular lighter socket.

9. The adaptor of claim 8, further comprising electrical circuitry disposed within the handle, wherein the electrical circuitry is electrically coupled to the at least first and second electrical contacts.

* * * * *

UNITED STATES PATENT AND TRADEMARK OFFICE

CERTIFICATE OF CORRECTION

PATENT NO. : 6,767,256 B1
DATED : July 27, 2004
INVENTOR(S) : Faerber et al.

It is certified that error appears in the above-identified patent and that said Letters Patent is hereby corrected as shown below:

Column 4,
Line 58, the words “at least one détente;” should read -- d. at least one détente; --.

Column 5,
Line 4, the words “at least one détente;” should read -- d. at least one détente; --.

Signed and Sealed this

Eighth Day of March, 2005

JON W. DUDAS
*Director of the United States Patent and Trademark Office*